US006839029B2

(12) United States Patent
Mendolia et al.

(10) Patent No.: US 6,839,029 B2
(45) Date of Patent: Jan. 4, 2005

(54) METHOD OF MECHANICALLY TUNING ANTENNAS FOR LOW-COST VOLUME PRODUCTION

(75) Inventors: Greg S. Mendolia, Ellicott City, MD (US); James Scott, Laurel, MD (US)

(73) Assignee: Etenna Corporation, Laurel, MD (US)

( * ) Notice: Subject to any disclaimer, the term of this patent is extended or adjusted under 35 U.S.C. 154(b) by 142 days.

(21) Appl. No.: 10/272,252

(22) Filed: Oct. 16, 2002

(65) Prior Publication Data

US 2003/0174096 A1 Sep. 18, 2003

Related U.S. Application Data

(60) Provisional application No. 60/364,502, filed on Mar. 15, 2002.

(51) Int. Cl.[7] ..... H01Q 1/38

(52) U.S. Cl. ..... 343/700 MS; 29/600

(58) Field of Search ..... 343/700 MS, 702, 343/846, 767, 770; 29/600

(56) References Cited

U.S. PATENT DOCUMENTS

| | | | | |
|---|---|---|---|---|
| 48,514 | A | 7/1865 | Butler | |
| 916,813 | A | 3/1909 | Whitney | |
| 1,672,944 | A | 6/1928 | Jowett | |
| 2,676,802 | A | 4/1954 | O'Brien | |
| 4,076,236 | A | 2/1978 | Ionel | |
| 4,361,324 | A | 11/1982 | Baroi | |
| 4,529,197 | A | 7/1985 | Gogarty | |
| 4,566,690 | A | 1/1986 | Schook | |
| 4,880,229 | A | 11/1989 | Broussard | |
| 5,090,693 | A | 2/1992 | Liang et al. | |
| 5,171,199 | A | 12/1992 | Panagos | |
| 5,221,244 | A | 6/1993 | Doss | |
| 5,256,121 | A | 10/1993 | Brotman | |
| 5,341,149 | A | 8/1994 | Valimaa et al. | |
| 5,407,413 | A | 4/1995 | Kupferman | |
| 5,464,379 | A | 11/1995 | Zarecky | |
| 5,628,716 | A | 5/1997 | Brice | |
| 5,648,788 | A | 7/1997 | Bumstead | |
| 6,147,661 | A | 11/2000 | Nakagawa et al. | |
| 6,285,324 | B1 * | 9/2001 | Korisch et al. | 343/700 MS |
| 6,307,512 | B1 * | 10/2001 | Geeraert | 343/702 |
| 6,333,716 | B1 * | 12/2001 | Pontoppidan | 343/702 |
| 6,486,837 | B2 * | 11/2002 | Spiegel et al. | 343/702 |
| 2003/0174092 | A1 * | 9/2003 | Sullivan et al. | 343/702 |
| 2004/0075608 | A1 * | 4/2004 | Scott et al. | 343/700 MS |

FOREIGN PATENT DOCUMENTS

| | | |
|---|---|---|
| FR | 812677 | 5/1937 |
| GB | 0018336 | 11/1890 |
| GB | 2135894 A | 9/1984 |

OTHER PUBLICATIONS

Copy of corresponding pending provisional application U.S. Ser. No. 60/354,502, filed on Mar. 15, 2002, 58 pages.

Copy of corresponding pending non–provisional application U.S. Ser. No. 10/211,731, filed on Aug. 2, 2002, 24 pages.

Copy of corresponding pending non–provisional application U.S. Ser. No. 10/242,087, filed on Sep. 12, 2002, 27 pages.

Copy of corresponding pending npn–provisional application U.S. Ser. No. 10/263,142 filed on Oct. 2, 2002, 27 pages.

Advertisement of Bollinger Industries as Appearing in the Nov. 1999 Issue of "Shape" Magazine; p. 36.

* cited by examiner

*Primary Examiner*—Tan Ho
(74) *Attorney, Agent, or Firm*—Brinks Hofer Gilson & Lione

(57) ABSTRACT

A method for tuning an antenna includes cutting a portion of a metal pattern molded with a plastic insert to adjust electrical characteristics of the antenna. Tuning can be performed by cutting the metal pattern or by cutting the completed antenna including both the metal pattern and the plastic insert.

19 Claims, 4 Drawing Sheets

VIEW A-A

METHOD OF MECHANICALLY TUNING ANTENNAS FOR LOW-COST VOLUME PRODUCTION

RELATED APPLICATIONS

This application is related to U.S. provisional application Ser. No. 60/364,502 entitled "Method For Fabrication of Miniature Lightweight Antennas," filed Mar. 15, 2002 in the names of Greg S. Mendolia, William E. McKinzie III and John Dutton and commonly assigned to the assignee of the present application; U.S. application Ser. No. 10/263,142 entitled "Method Of Manufacturing Antennas Using Micro-Insert-Molding Techniques," filed Oct. 2, 2002 in the names of Greg S. Mendolia and Yizhon Lin; and U.S. application Ser. No. 10/211,731 entitled "Miniature Reverse-Fed Planar Inverted F Antenna," filed Aug. 2, 2002 in the names of Greg S. Mendolia, John Dutton and William E. McKinzie III and commonly assigned to the assignee of the present application, all of which related applications are incorporated herein in their entirety by this reference.

BACKGROUND

This invention relates generally to manufacturing antennas repeatably in high volume for a variety of applications and integration environments. More particularly, the present invention relates to a method of mechanically tuning antennas for low-cost, volume production.

There are various realizations of internal antennas for portable devices, but a select few embodiments are most common due to the need for low cost and reproducible manufacturing approaches. Internal antennas are those contained wholly within a radio product, as distinct from external antennas such as whip antennas or antennas that may be extended from an internal stowed position to an active position. These antennas are typically small, but there is no well defined upper limit to the size and form factor of such antennas.

Antennas are often fabricated using stamped metal draped over plastic, patterned fiberglass (FR4) Printed Circuit Board (PCB) material, or metallized and patterned plastic. FIG. 1 shows an example of a prior art antenna assembly 100 in which a metal antenna is supported on a plastic support structure. The antenna assembly 100 includes a sheet metal antenna and a plastic support mounted on a ground plane. Construction of the antenna assembly 100 requires bending the sheet metal into the desired antenna shape, and draping the antenna sheet metal over the plastic stand-off or support. The metal is either stamped out of a separate piece of metal or may be plated directly on plastic.

A second example of prior art antenna construction uses insert molded plastic. One material which may be used is Liquid Crystal Polymer (LCP) for the molded plastic and plated copper for the insert metal. Other materials may be substituted for the LCP and copper as required by particular design and product requirements. The LCP can withstand high temperatures, and is compatible with standard Surface Mount Technologies (SMT) for assembly. Micro-injection molding the antenna allows tight mechanical tolerance control of all dimensions of the antenna.

Manufacturers of wireless devices such as radiotelephone handsets, personal digital assistants (PDA's) and laptop computers are constantly pressured to reduce the size and cost of their products. Existing antenna solutions often shift frequency response when they are integrated into products. More seriously, the amount of frequency shift is different for each application, and is often different for very similar applications. For instance, an original equipment manufacturer (OEM) which produces laptop computers may have many different laptop models, or platforms. Current antennas would "de-tune" by a different amount for each platform, or for different mounting locations within one given platform. This forces the OEM to carry multiple part numbers of antennas for each integration into these multiple model numbers. This drives product cost upwards due to increased inventory requirements, lower economies of scale, and increased complexity and logistics associated with multiple antenna solutions.

Often, there are extensive up-front tooling costs to manufacture antennas, especially if the antennas are molded out of plastic. This tooling cost is a significant portion of the total cost of the antenna. If slightly different antennas are needed for each and every application, the antenna's unit cost would be prohibitive. Hence, there is a real need for either an antenna that is less sensitive to installation effects, or an antenna that can be easily modified during production so that tooling costs are not affected.

BRIEF SUMMARY

By way of introduction, the presently disclosed invention proposes a simple way to re-center an antenna's frequency response without additional tooling costs. An antenna includes a molded plastic spacer and a metal insert fabricated using micro-insert molding processes. The metal insert includes one or more tuning mechanisms for tuning electrical characteristics of the antenna. A method for tuning an antenna includes cutting a portion of a metal pattern molded with a plastic insert to adjust electrical characteristics of the antenna.

The foregoing summary has been provided only by way of introduction. Nothing in this section should be taken as a limitation on the following claims, which define the scope of the invention.

DETAILED DESCRIPTION OF THE PRESENTLY PREFERRED EMBODIMENTS

Figure 1:
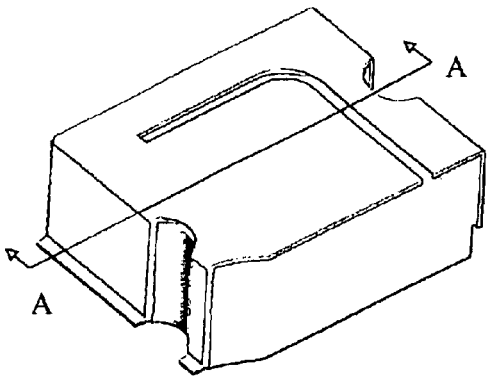
FIG. 1 is a prior art antenna assembly.
Figure 2:
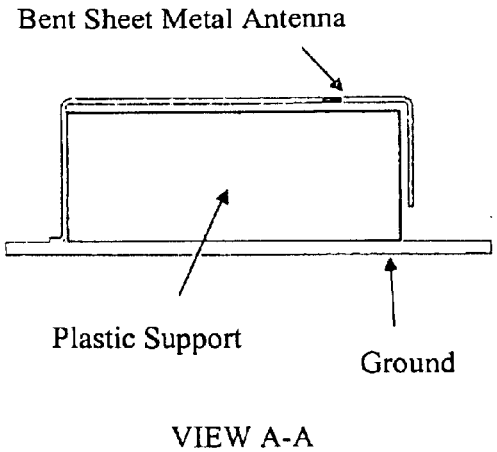
FIG. 2 is a first isometric view of an antenna.
Figure 2:
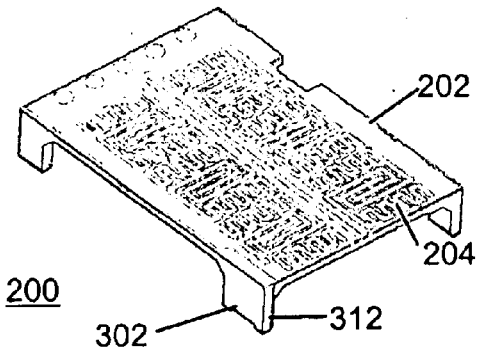
Figure 3:
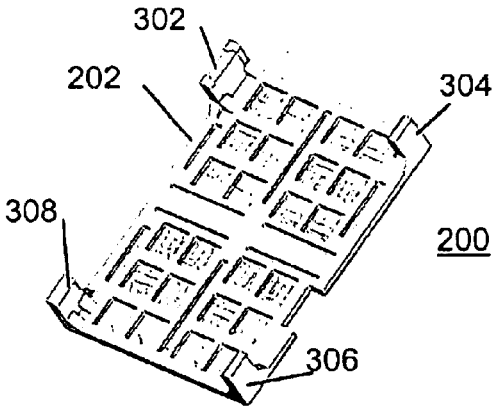
FIG. 3 is a second isometric view of the antenna of FIG. 2.
Figure 4:
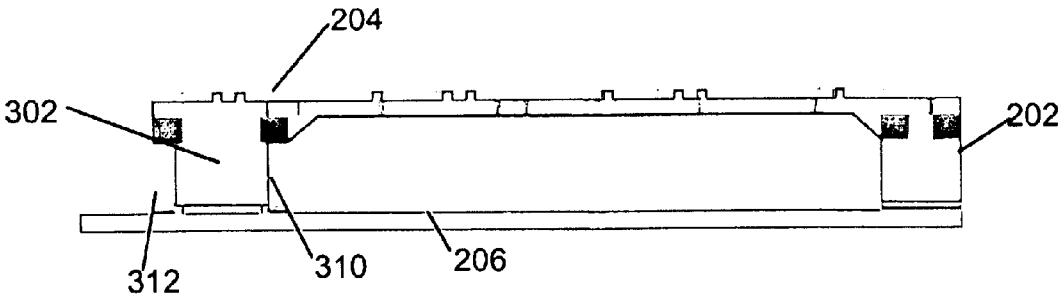
FIG. 4 is a cross-sectional view of the antenna of FIG. 2.

The proposed antenna departs from the antenna shown in FIG. 1 by using well established micro-insert molding techniques to manufacture the antenna with much more control on mechanical tolerances and significantly lower total cost. One embodiment for fabrication of an antenna using this method is shown in FIGS. 2, 3 and 4. FIG. 2 is a first isometric view of an antenna 200. FIG. 3 is a second isometric view of the antenna 200 of FIG. 2. FIG. 4 is a cross-sectional view of the antenna 200 of FIG. 2. As can be seen in the figure, the metal of the antenna is captured in plastic during an insert molding process. The particular antenna shown is a reverse-fed DCL-FSS antenna of the type described in the incorporated patent application. Other specifics of the antenna may be found in currently pending related U.S. application Ser. No. 10/272,435 entitled "Multiband Antenna Having Reverse-Fed PIFA," filed Oct. 16, 2002 in the names of Greg S. Mendolia and James Scott and commonly assigned to the assignee of the present application, incorporated herein by reference in its entirety.

The antenna 200 includes a molded plastic spacer 202 and a metal insert 204. The plastic spacer 202 is configured for mounting to a printed circuit board (PCB) 206 to maintain the metal insert 204 a predetermined distance from a ground plane, such as a ground plane of the PCB 206. The antenna 200 is fabricated by joining the metal insert 204 and the plastic spacer 202 in a micro-injection-molding process. Additional features of this antenna are disclosed in U.S. application Ser. No. 10/263,142 entitled "Method of Manufacturing Antennas Using Micro-Insert-Molding Techniques," filed Oct. 2, 2002 in the names of Greg S. Mendolia and Yizhon Lin.

As can be seen in FIGS. 3 and 4, in this exemplary embodiment, the plastic spacer 202 is table-top shaped with a plurality of legs 302, 304, 306, 308 configured for PCB mounting. The antenna 200 includes a ground lead 310 and a feed 312 extending on one or more legs of the plurality of legs and configured for electrically connecting the metal insert with the printed circuit board. In the illustrated embodiment, the ground lead 310 and the feed 312 extend along the length of one leg 302. In other embodiments, these conductors may be separated or multiple ground leads or multiple feeds may be substituted. In non-PIFA applications, the required electrical connections may dictate a different mechanical connection.

The metal insert 204 is formed by patterning a metal conductor to the required antenna design. The metal insert 204 is a generally planar, unitary, conductive device. In one embodiment, the metal insert is fabricated from copper plated with a common finish such as nickel, tin or gold. In other embodiments, other conductive components, even non-metallic conductors or dielectric components, may be substituted for all or part of the metal insert 204.

Patterning in one embodiment is accomplished by etching, cutting or stamping the metal conductor. Etching may be achieved by, for example, a chemical photolithographic process. Devices and processes for patterning the metal insert 204 are well known or may be readily adapted to particular requirements.

The challenge for most internal antennas used in portable wireless electronics is to minimize the size requirements while keeping cost and performance at acceptable levels. This size constraint limits the electrical bandwidth of the internal antennas, often barely being able to cover the frequency band of interest. Therefore, any variation of the antenna's frequency response will result in a shift in performance upwards or downwards in frequency. This frequency shift results in antenna performance that is not centered in the desired band, and hence a failure to meet specification will cause the part to be rejected.

Antennas radiate at frequencies which are dependant on their geometry, their height above the ground plane, and the dielectric constant of the materials that they are made of. Manufacturing antennas using micro-insert molding virtually eliminates variations in these geometries, resulting in a very repeatable fabrication of antennas. The electrical performance of the antenna is mainly determined by the metal insert and its position, and not the plastic used to capture the insert. The plastic insert is there only to hold the metal in place to exacting dimensions. FIG. 4 shows a cross section of such an antenna.

However, even if an antenna is manufactured perfectly, and its frequency response as tested in the factory is within specifications, there can often be a shift in frequency response depending on components near the antenna when it is mounted in the final product. Other surface mount components adjacent to the antenna on the main PCB, components mounted under the antenna, and even the product's housing if located close enough to the antenna (for example, within ~1.0 mm) will cause a frequency shift, usually downwards to a lower frequency. In body worn products such as hands-free ear buds and cell phones a frequency shift can occur if any part of the user's body is close enough to the antenna. This loading effect can be reduced partly by the electrical design of the antenna, but will still remain to some degree.

If the frequency shifts due to the above factors are known for a given application or product platform, the antenna design can be modified to accommodate for the shift, so that the final frequency response when the antenna is installed in the product is on target. However, most plastic antennas are fabricated in a way such that these design changes would result in substantial hard-tooling cost and time delays in being able to produce in volume.

Producing antennas using micro-insert molding techniques allows a great deal of flexibility in the design of antennas. The mold that accepts the lead frame is very flexible in terms of what the metal pattern that the mold accepts can look like. The lead frames in some embodiments are produced in a progressive die stamping operation. Changing one or more of the operations in the progressive die can tune the antennas without changing the process at the micro-insert molders or causing a large retooling operation at the stamping house.

FIGS. 5–10 illustrate exemplary antenna metallization for tuning the antenna of FIG. 2. In each of FIGS. 5–10, the metal pattern is sized and configured according to design goals for the particular antenna to be formed using the illustrated metallization. These examples of tuning mechanisms are commensurate with being produced by conventional stamping techniques, although any suitable manufacturing technique may be used. The antennas shown below are all Reverse Fed Planar Inverted F Antennas (RFPIFA). Thus, each of the antennas has a radio frequency (RF) feed and RF short near one corner. However, the illustrated tuning techniques are general enough to be extended to many different types of antennas.

Figure 5:
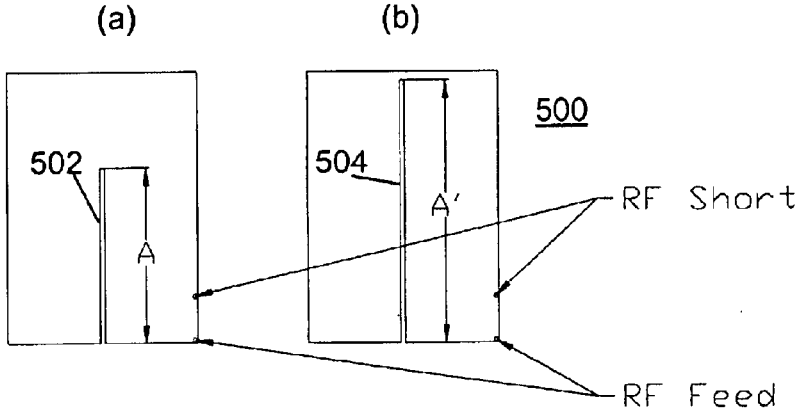
FIGS. 5–10 illustrate exemplary antenna metallization for tuning the antenna of FIG. 2.

FIG. 5 shows the outline of an antenna metal pattern 500 for an RFPIFA such as the antenna 200 of FIG. 2. In the two exemplary embodiments of FIG. 5(*a*) and FIG. 5(*b*), the antenna metal pattern 500 has been cut with a slot, 502, 504 respectively. The slot 502 has a length A. The slot 504 has a length A'. In some embodiments, the slot 502, 504 is cut in only the metal pattern 500. In other embodiments, the slot 502, 504 is cut through both the metal insert and the plastic spacer with which the metal insert is joined. This may be done using a blade to cut the metal pattern or to cut through the metal and the plastic insert. Alternatively, any cutting device such as a laser may be used, particularly in conjunction with automatic test equipment, as will be described below.

The resonant frequency of the RFPIFA using the metal pattern 500 can be changed by changing the length of the slot 502, 504 that is cut down the middle of the RFPIFA. In FIG. 5, when the slot is extended from length A to A' the resonant frequency of the RFPIFA will be reduced considerably. Thus, to tune the RFPIFA made with the metal pattern 500, a slot length in the metal pattern can be chosen to produce a particular resonant frequency.

Figure 6:
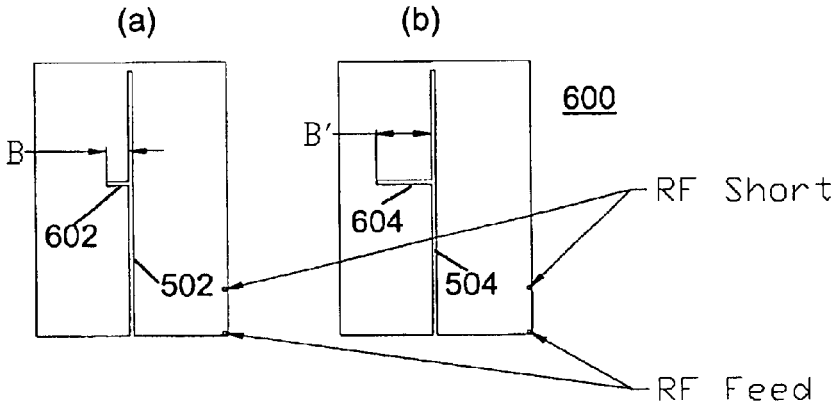

FIG. 6 shows the outline of an antenna metal pattern 600 for an RFPIFA such as the antenna 200 of FIG. 2. In the two exemplary embodiments of FIG. 6(*a*) and FIG. 6(*b*), the antenna metal pattern 600 includes a primary slot 502, 504 and a secondary slot 602. The secondary slot is cut in the antenna 600 in intersection with the primary slot.

In other embodiments, the antenna metal pattern 600 may include one or more primary slots and one or more secondary slots. The pattern and intersection of the primary and secondary slots may be adjusted to tune various electrical characteristics of the antenna. For example, enlarging the secondary slot 602, 604 is equivalent to inserting lumped series inductance into the RFPIFA. As the length of the slot is increased, the resonant frequency of the antenna is reduced. In particular embodiments, a single antenna can have multiple slots or a pattern of slots such as the primary slots 502, 504 and the secondary slots 602, 604, to increase the tuning range of the antenna.

Figure 7:
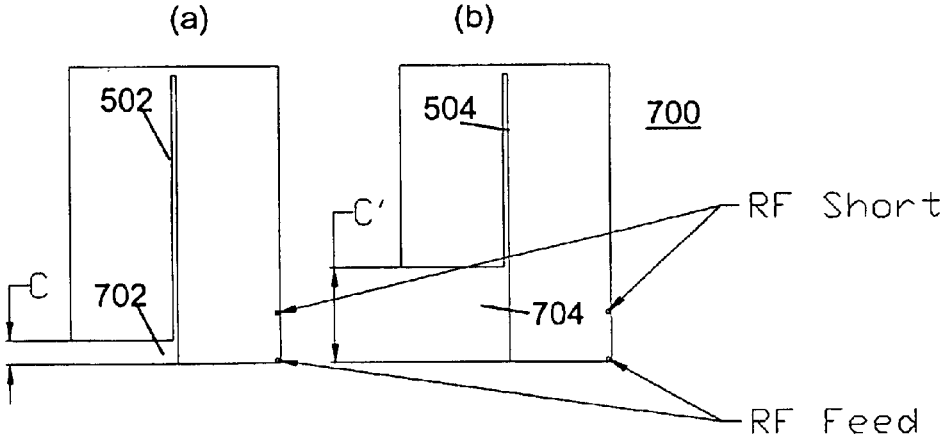

FIG. 7 shows the outline of an antenna metal pattern 700 for an RFPIFA such as the antenna 200 of FIG. 2. The two exemplary embodiments of FIG. 7(*a*) and FIG. 7(*b*) illustrate another possible way to tune antennas in the stamping process by adjusting a cut that cuts all the way through the RFPIFA. The antenna made using the metal pattern 700 has two arms separated by a slot 504. In this embodiment, tuning is provided by mismatched geometries of the arms.

Stamping tools can be made to have an adjustable cutting operation that could be used to change the length of one of the arms of the metal pattern 700 for an RFPIFA of FIG. 7. The metal pattern 700 in the embodiments of FIGS. 7(*a*) and 7(*b*) includes a slot 502, 504. Also, the metal pattern includes a cut 702, 704 respectively in which a portion of the metal pattern has been removed or cut away. The intact portion of the metal pattern is illustrated in the drawing. A sacrificial portion has been cut away, leaving the intact portion. In FIG. 7(*a*), the cut 702 has a width C. In FIG. 7(*b*), the cut 704 has a width C'. Changing the width of the cut from C to C' causes the resonant frequency of the RFPIFA to increase. The cut can extend through the thickness of the RFPIFA, including the metal pattern and the plastic spacer on which the metal pattern 700 is molded or otherwise formed, or the cut can only extend through the metal pattern leaving the dielectric plastic substantially intact. The cut produces mismatched geometries of the two arms. In other embodiments, the antenna may be separated into more than two arms, each having its own geometry chosen to tune the antenna.

Figure 8:
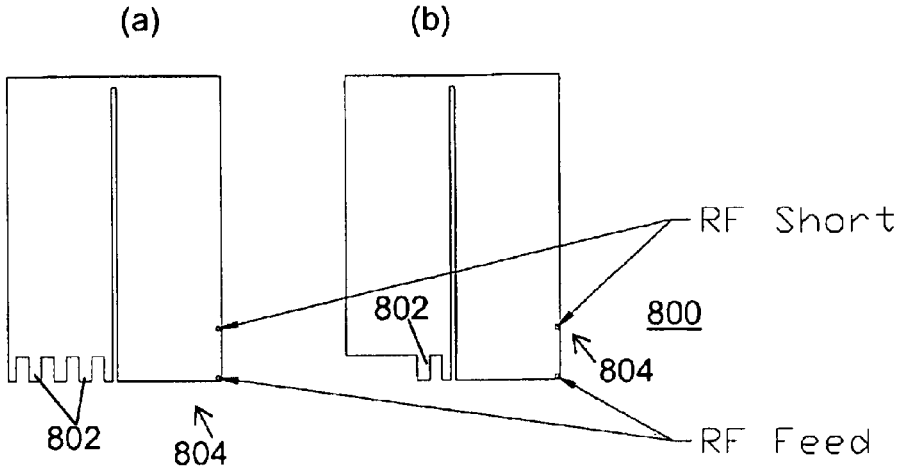

FIG. 8 shows the outline of an antenna metal pattern 800 for an RFPIFA such as the antenna 200 of FIG. 2. The exemplary embodiments of FIG. 8(*a*) and FIG. 8(*b*) show an RFPIFA with a body and with several metal fingers 802 extending from the body at the open end of the antenna metal pattern 800. The fingers 802 can be formed by cutting metal portions off one end 804 of antenna metal pattern 800 to raise the resonant frequency.

This method of tuning is very similar to the method described in FIG. 7. However, the antenna of FIG. 8 can be produced by insert molding and with all fingers intact. After manufacturing, during a final test operation, the antenna using the metal pattern 800 can be discretely tuned after it is produced by cutting fingers off of the end of the RFPIFA. In one embodiment, the metal pattern 800 of FIG. 8(*a*) corresponds to the un-tuned antenna pattern. After tuning, the metal pattern of FIG. 8(*b*) remains. The number and relative positioning of the remaining fingers 802 control the resonant characteristics of the antenna.

The tuning process may be implemented automatically by test equipment, for example using a laser or other cutting device to remove fingers 802 and tune a resonance characteristic, such as resonant frequency, of the antenna made using the metal pattern 800. A method for testing the antenna begins with all fingers 802 intact. An initial test condition is applied to the antenna. Subsequently, fingers 802 may be removed sequentially to adjust the resonant characteristics of the antenna. For example, fingers may be removed in a left to right sequence in the embodiment shown in FIG. 8. Alternatively, depending on the response of the antenna to the initial test condition, individual fingers 802 or groups of fingers 802 may be removed to adjust the antenna response. A repeated process of cutting metal, applying a test condition and measuring the antenna's response may be applied until electrical characteristics of the antenna are within a tolerance range. The automatic test equipment may use a table of known performance characteristics to select fingers to remove to adjust the tuning of the antenna.

In the illustrated embodiment, the fingers 802 extend from an external perimeter of the antenna. In other embodiments, an internal perimeter may be formed by designing the antenna with a slot or other aperture having an internal perimeter. The fingers may extend from the internal perimeter.

Figure 9:
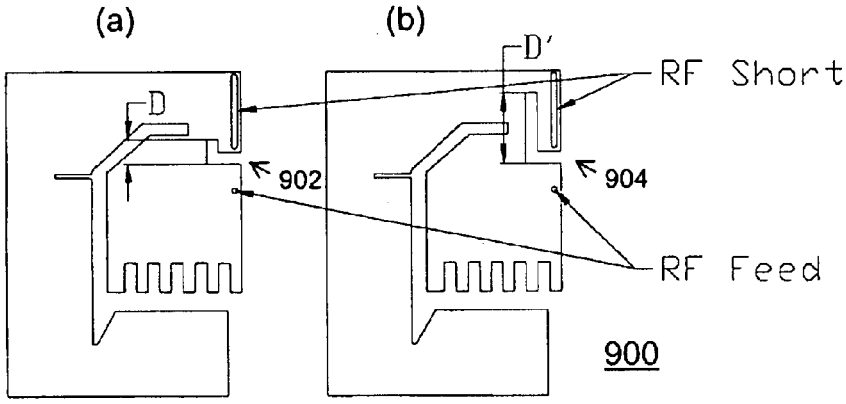

FIG. 9 shows the outline of an antenna metal pattern 900 for an RFPIFA such as the antenna 200 of FIG. 2. The exemplary embodiments of FIG. 9(*a*) and FIG. 9(*b*) show another apparatus and method for tuning an RFPIFA. In this embodiment, the focus is on varying the impedance match of the antenna. The RF feed and the RF short for the antenna are labeled in the drawing figure. The distance between the feed and the short is a critical factor in determining the match of the antenna. FIG. 9 illustrates an embodiment of a metal pattern for an antenna having an inner perimeter and fingers extending from the inner perimeter. A slot has been formed in the RFPIFA of FIG. 9, extending from the external perimeter to the internal section of the RFPIFA. Along the inner perimeter of the slot, fingers extend and may be cut to tune the antenna.

One way that the match could be altered for better in-situ performance on a production part would be to introduce a slot with variable length between the feed and the short. Thus, in FIG. 9(*a*), a slot 902 separates the feed and the short. The distance D between the feed and the short is due at least in part to the slot 902. In FIG. 9(*b*), a slot 904 separates the feed and the short. The distance D' between the feed and the short due is at least in part to the slot 904.

By introducing a slot such as the slots 902, 904, resonant characteristics including the resonant frequency of the antenna are lowered as the length of the slot is increased. Thus, an antenna using the metal pattern 900 of FIG. 9(*b*) will have a lower resonant frequency than an antenna using the otherwise identical metal pattern 900 of FIG. 9(*a*). More importantly in some applications, some control is afforded over the match of the antenna by varying the length of the slot.

Moreover, the length of the slot may be varied dynamically during a final test operation, using a laser or other cutting tool. An initial test condition may be provided to test the antenna initially, and then one or more cuts made to vary the slot length and the distance between the feed and short. Subsequent test conditions may be applied to the antenna and performance measurements taken until a desired antenna characteristic is obtained.

Measured results demonstrate how effective this method of tuning antennas can be. In one embodiment, an RFPIFA can be tuned from a center frequency of 2.95 GHz down to well below 2.44 GHz by adjusting the length of the slot in the center of the antenna.

Figure 10:
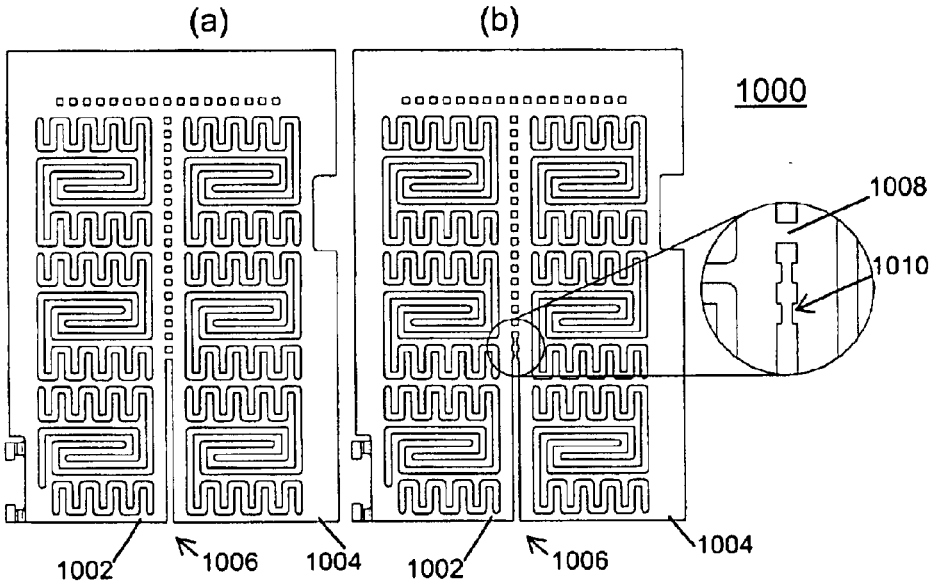

FIG. 10 illustrates the top of an antenna 1000 useful for determining the correct tuning position for any given application. The antenna 1000 of FIG. 10 includes two antenna halves 1002, 1004 separated by a slot. Each of the halves 1002, 1004 includes a serpentine, interdigitated metallization pattern but any suitable metal pattern may be used. The slot 1006 across the middle of the antenna 1000 is bridged by many small tuning straps 1008. The tuning straps 1008 may be cut away with a blade, laser or any other cutting device to selectively extend the length of the slot 1006 to tune the antenna 1000 to the correct frequency after it is installed on a customer's board. Other resonant characteristics may be tune as well.

FIG. 10(*a*) shows an antenna 1000 that has not yet been tuned. In FIG. 10(*b*), the lowest two tuning straps that bridge the two halves of the antenna 1000 have been cut away to lower the resonant frequency of the RFPIFA, leaving cut tuning straps 1010.

FIG. 10 thus illustrates one way in which the correct tuning position for an antenna can easily be found for any given application. The straps in one embodiment are 0.2 mm wide and are separated by a gap of 0.2 mm. Sizes and geometries other than those shown herein may be substituted. In this embodiment, cutting a single strap is approximately the same as making the slot 0.4 mm longer. Around the desired frequency of operation of 2.4 GHz, cutting a single strap lowers the resonant frequency of the antenna 25–30 MHz.

Figure 11:
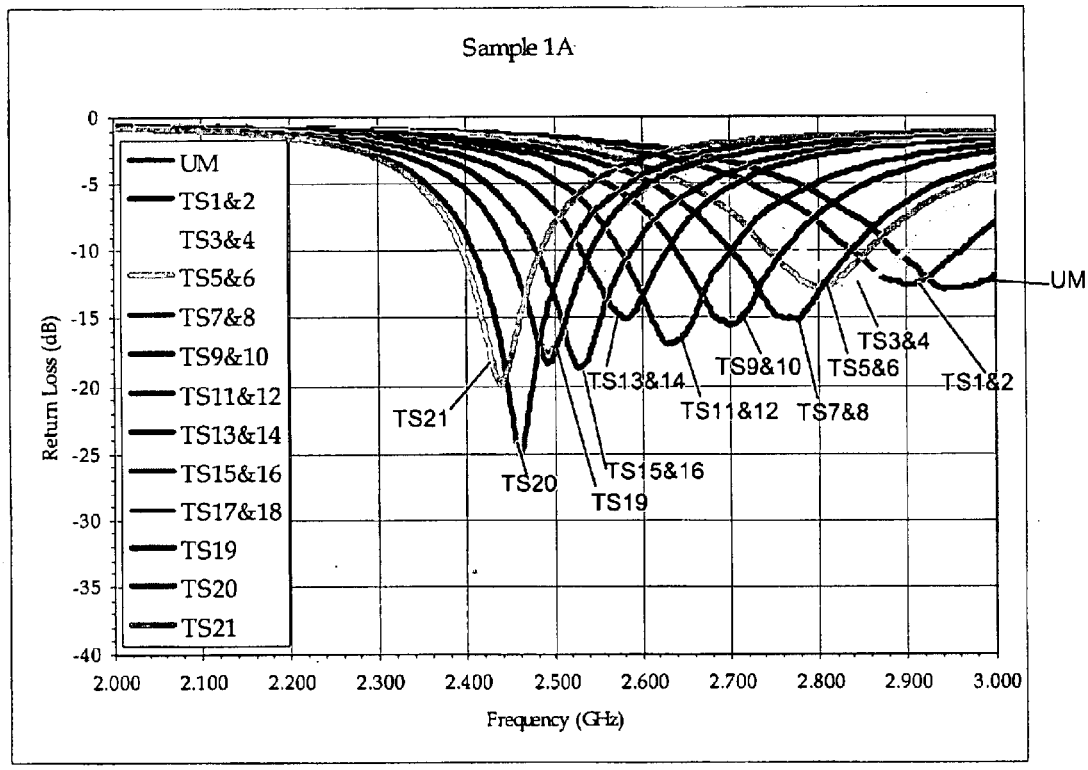
FIG. 11 illustrates the return loss for the antenna of FIG. 10

FIG. 11 is a tuning chart that gives the return loss for the antenna 1000 of FIG. 10 from the initial state to when it is tuned to 2.44 GHz. It can be seen that the antenna has a very robust tuning mechanism that allows it to operate anywhere from 2.95 GHz to 2.44 GHz with excellent match. The mechanical tuning mechanism demonstrated here has more than enough tuning range to allow this antenna to be matched to any given platform which will allow the same production tooling to be used to produce an antenna that can be used for many different products and customers.

From the foregoing, it can be seen that the disclosed embodiments provide an improved method and apparatus for mechanically tuning an antenna. The environment an antenna is placed in will significantly affect the antenna's resonant characteristics including resonant frequency. The mechanical tuning mechanisms illustrated herein and extensions thereof will allow a single production tool to produce antennas that will work in many different environments. The process used also cuts down the amount of time needed to get a customized antenna solution into volume production because the tooling already exists to make the parts. Only a small adjustment in the production tooling is needed in order to produce a new part for a customer.

While a particular embodiment of the present invention has been shown and described, modifications may be made. It is therefore intended in the appended claims to cover such changes and modifications which follow in the true spirit and scope of the invention.

What is claimed is:

1. An antenna comprising a molded plastic spacer and a metal insert fabricated using micro-insert molding processes, the metal insert including one or more tuning mechanisms for tuning electrical characteristics of the antenna, the one or more tuning mechanisms including one or more primary slots cut in the antenna; and one or more secondary slots cut in the antenna in intersection with at least some of the one or more primary slots.

2. The antenna of claim 1 wherein the one or more slots comprise:

one or more slots cut in the metal insert of the antenna.

3. The antenna of claim 1 wherein the one or more slots are cut to lengths associated with the predetermined electrical characteristics of the antenna.

4. The antenna of claim 3 wherein the one or more slots are cut to lengths to tune the resonant frequency of the antenna.

5. The antenna of claim 1 wherein the one or more primary slots and the one or more secondary slots are cut in a pattern and to lengths to tune the electrical characteristics of the antenna.

6. The antenna of claim 1 wherein the antenna has two or more arms and wherein the one or more tuning mechanisms comprise:

mismatched geometries of the two or more arms.

7. The antenna of claim 6 wherein the one or more tuning mechanisms comprise:

intact portions of the two or more arms, the intact portions remaining after sacrificial material has been cut away.

8. The antenna of claim 6 wherein the one or more tuning mechanisms comprise:

one or more fingers extending from the body and configured to be cut away from the body.

9. The antenna of claim 8 wherein the one or more fingers extend from an external perimeter of the body.

10. The antenna of claim 8 wherein the one or more fingers extend from an internal perimeter of the body.

11. The antenna of claim 1 wherein the one or more tuning mechanisms comprise:

one or more tuning straps linking portions of the metal insert and configured to be cut to tune the electrical characteristics of the antenna.

12. The antenna of claim 1 wherein the one or more tuning mechanisms comprise:

a slot extending between portions of the metal insert; and tuning straps bridging the slot and configured to be cut to selectively extend the length of the slot.

13. A method for tuning an antenna, the method comprising:

applying an initial test condition to the antenna;

measuring antenna response to the initial test condition;

cutting a portion of a metal pattern molded with a plastic insert to adjust electrical characteristics of the antenna;

applying a next test condition to the antenna;

measuring antenna response to the next test condition; and repeatedly cutting, applying and measuring until the electrical characteristics of the antenna are within a tolerance range.

14. The method of claim 13 wherein cutting comprises cutting one or more slots in the metal pattern.

15. The method of claim 14 wherein cutting one or more slots comprises cutting one or more primary slots and one or more intersecting secondary slots in the metal pattern.

16. The method of claim 13 wherein cutting comprises cutting away a portion of the metal pattern.

17. The method of claim 13 wherein cutting comprises cutting fingers extending from a perimeter of the metal pattern.

18. The method of claim 13 wherein cutting comprises cutting tuning straps bridging portions of the metal pattern.

19. The method of claim 13 wherein cutting comprises extending a slot in the metal pattern by cutting tuning straps bridging an end of the slot.

* * * * *